United States Patent [19]

Lutz

[11] 4,165,013

[45] Aug. 21, 1979

[54] COVERED CUP

[76] Inventor: Timothy J. Lutz, 116 Warwick Dr., Walnut Creek, Calif. 94598

[21] Appl. No.: 900,912

[22] Filed: Apr. 28, 1978

Related U.S. Application Data

[63] Continuation-in-part of Ser. No. 822,722, Aug. 8, 1977, abandoned.

[51] Int. Cl.[2] ..... A47G 19/22; B65D 43/26; B65D 43/16

[52] U.S. Cl. ..... 220/215; 220/90.4; 220/264; 220/331; 220/336; 220/367; 222/471; 222/517

[58] Field of Search ..... 220/331, 336, 348, 90.4, 220/262, 263, 264, 215, 367; 222/505, 515, 471, 518, 517

[56] References Cited

U.S. PATENT DOCUMENTS

| | | | |
|---|---|---|---|
| 253,725 | 2/1882 | Leach | 220/331 |
| 256,566 | 4/1882 | Heffley, Sr. | 220/367 X |
| 281,189 | 7/1883 | Jackson | 222/518 X |
| 535,578 | 3/1895 | Frosch | 220/331 |
| 1,028,499 | 6/1912 | Schatt | 220/331 |
| 2,195,033 | 3/1940 | Lehman | 220/336 X |
| 2,281,380 | 4/1942 | Peterson | 222/473 |
| 2,749,727 | 6/1956 | Fabro | 222/470 X |
| 3,396,876 | 8/1968 | Workman et al. | 222/474 |
| 3,814,298 | 6/1974 | Hansen | 222/473 |

*Primary Examiner*—Allan N. Shoap
*Attorney, Agent, or Firm*—Phillips, Moore, Weissenberger, Lempio & Majestic

[57] ABSTRACT

A cup having a manually actuated cover is disclosed. The cover is associated with an actuating system disposed in the handle so that thumb pressure on a push rod causes the cover to move upwardly and rotate to one side to uncover the cup and allow the user to drink therefrom. The cover is associated with the actuating system by a socket arrangement to allow removal of the cover for cleaning of the cup and cover separately.

9 Claims, 12 Drawing Figures

COVERED CUP

This is a continuation-in-part of U.S. Patent Application Ser. No. 822,722, filed Aug. 8, 1977 and now abandoned.

BACKGROUND OF THE INVENTION

Covered drinking receptacles are old in the art; however, such drinking receptacles usually suffer from one or more drawbacks. This invention relates to a covered drinking cup which overcomes these drawbacks, and specfically relates to a covered drinking cup wherein the cover is rotatable about an axis generally parallel to the longitudinal axis of the handle upon actuation by a thumb-operated push lever.

Covering drinking cups serve several useful purposes. Initially, a cover over a drinking cup prevents the entry of unwanted material, such as dirt or the like, from entering the cup and contaminating the liquid contained therein. Secondly, a cover may serve to retain a degree of heat in the cup if the cup is used for hot liquids. Finally, a cover can serve to prevent sudden spillage of liquid contained in the cup when the cup is overturned. However, in order to provide flexibility to the user, a certain degradation in the tightness of the seal formed by the cover is lost in any cup. In the past, covered cups generally failed in this area, in that the cover did not adequately seal, or if the cover did adequately seal, the opening provided upon actuation of the cover mechanism was either awkward or of inadequate size to allow proper usage of the cup. Another common problem in covered cups is the failure to provide provision for venting the cup in the event a hot or ice-cold liquid was placed therein. The loss of heat from a hot fluid, or the gain of heat in a cool fluid, will cause the cover to be pulled inwardly in the first instance, or forced outwardly in the second instance. In the case of the hot fluid, the cover may become "stuck" to the cup by the vacuum formed therein, thus preventing use of the cup. In the case of the cold liquid, the cup cover will not seat properly as the expansion of the gas above the liquid as the liquid heats causes to cover to periodically become unseated. Therefore, it is appropriate to include a vent in any cover. The vent should be small enough so that normal drinking liquids will not pass through the vent in the event the cup overturns. Furthermore, the cover should be resiliently bound to the cup by spring action sufficiently strong to prevent the weight of the liquid from unseating the cover when it is in the closed position.

It was to meet and overcome these limitations that this invention was developed.

SUMMARY OF THE INVENTION

It is a primary object of this invention to provide a covered cup which is generally spill-proof.

It is a further object of this invention to provide a covered cup which may easily be opened by the user while the cup is held.

Broadly stated, the invention is a cup including a cup member having a handle affixed to the cup member. A cover is associated with the handle for covering the cup. Disposed in the handle and associating the cover with the handle is a rotating assembly responsive to manual pressure for raising and rotating the cover so that the cup is uncovered.

DETAILED DESCRIPTION OF ONE EMBODIMENT

Figure 1:
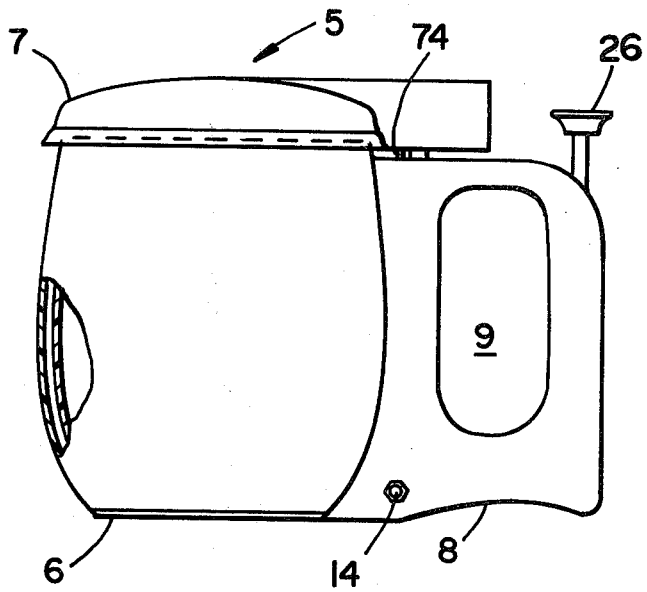
FIG. 1 is a side elevation view of a covered cup incorporating the provisions of this invention.

Referring to FIG. 1, a cup 5 comprised of a cup member 6, a cover 7, and a handle 8, is shown. Cup member 6 may be of a plastimer material and further may be double-walled to provide heat insulation. However, the limitation of a double-wall and of a plastimer material should not be considered as limiting in this invention. Rather, any conventionally designed cup to which the cover and handle described below may be readily affixed is appropriate for this invention.

Figure 2:
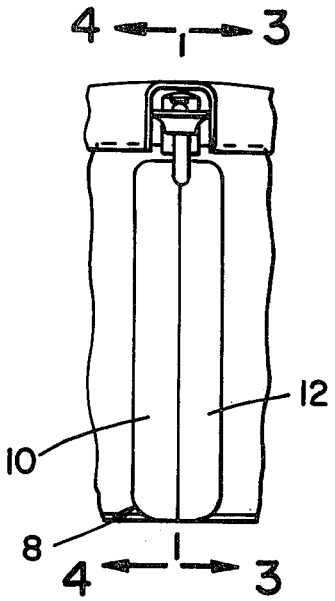
FIG. 2 is a portion of a rear elevation view of the cup shown in FIG. 1.
Figure 4:
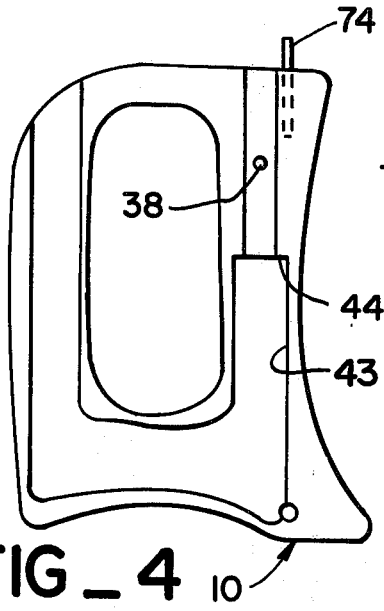
FIG. 4 is a sectional view of the opposite half of the handle shown in FIG. 2 and taken at section IV—IV.
Figure 3:
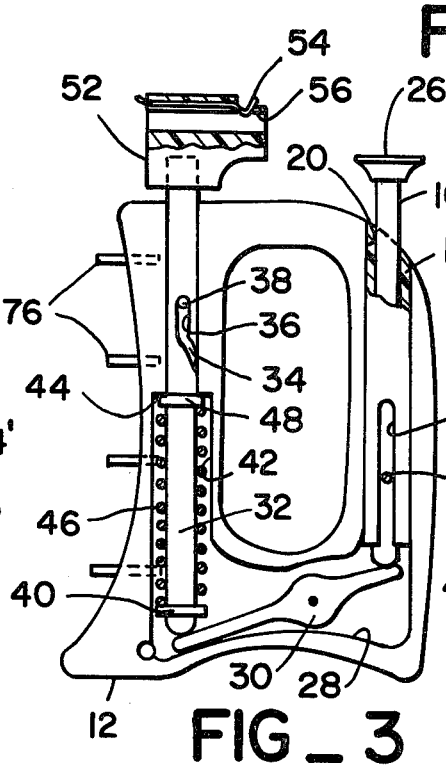
FIG. 3 is a cutaway elevation view of the rotating mechanism of the cup of FIG. 1 and taken at section lines III—III of FIG. 2.

Handle 8 is formed of a first section 10, shown in FIG. 4, and a second section 12, shown in FIG. 3. First section 10 and second section 12 are formed to fit in mating engagement, as shown in FIG. 2, for fixture to the cup by a plurality of pins 76 or the like. A fastening bolt, such as bolt 14 (see FIG. 1), may be utilized to affix one section to the other. Each section 10 and 12 has relieved portions on the mating sides in which the means for rotating the cover 7 is disposed. This rotating means or operating mechanism is best shown in FIG. 3 and includes a first push rod 16 disposed in a cylindrical sleeve 18 which may be affixed in a vertically oriented relieved portion 20 of second section 12. First push rod 16 may have a transverse pin 22 passing therethrough which is slidable in an axially oriented slot 24 in sleeve 18. The purpose of pin 22 is to prevent rotation of first push rod 16. Affixed to the end of first push rod 16 extending outwardly of handle 8 is a flange 26 which serves as a push-button-like surface for convenience of the user of the cup.

Pivotally mounted in a relieved portion 28 of first section 12 and at the base thereof is a pivoted member 30 which is responsive to reciprocation of the manually actuable first push rod 16. Specifically, first push rod 16 engages one end of the pivoted member 30. Pivoted member 30 engages at the other opposite end a second push rod 32. Relieved portion 28 and the corresponding relieved portion in first section 10 serve to limit pivotal rotation of pivoted member 30, thus proportionally limiting the responsive extension of second push rod 32.

Second push rod 32 defines, in the surface thereof, a helical slot 34 joining an axially oriented slot 36. A pin 38 is affixed in first section 10 (see FIG. 4) and extends inwardly toward helical slot 34 and axial slot 36. Specifically, with the cover 7 shown closed as in FIG. 1, and with the handle assembled, the pin 38 will be positioned in axial slot 36 at or near the uppermost end thereof with the cup oriented as shown in the drawings (see FIG. 3).

Push rod 32 is formed with means such as shoulder 40 proximate the pivoted member 30. As will be seen shoulder 40 forms an abutment surface for biasing means. The relieved portion 42 of second section 12 and the corresponding relieved portion 43 of first section 10 are formed with mating shoulders 44 and 44' against which a resilient member, such as helical spring 46, may abut. Helical spring 46 also abuts shoulder 40 at the other opposite end, thus urging second push rod 32 downwardly against pivoted member 30 which, in turn, urges first push rod 16 upwardly to the position shown in FIG. 3. A washer 48 may be appropriate to protect the shoulder 44 from undue wear imposed thereon by helical spring 46. It should be apparent to those in the art that downward pressure on flange 26 causes pivoted member 30 to rotate in a clockwise direction, as shown in FIG. 3, and urge the second push rod 32 upwardly in the opposite direction. Since pin 38 is fixed relative the handle 8, the axial slot 36 first causes the second push rod to move directly upwardly without rotation. As the second push rod moves further upwardly, the helical slot 34, acting as a cam surface, causes the second push rod to rotate. It should also be apparent to those in the art that the direction of rotation of the second push rod 32 can be controlled by the direction of the helix 34. Thus, in the cup shown, the handle 8, which would have incorporated therewith an opening 9 in which the user's hand would ordinarily pass through, would open into the plane of the paper as shown in FIG. 1, and would be appropriate for right-handed use. Conversely, if the helix 34 were directed in the opposite direction, the cup would be made to open in a direction out of the plane of the paper as shown in FIG. 1, and would be appropriate for lefthanded use.

Affixed to the top of second push rod 32 is a socket arrangement 52, which includes a detent 54. Socket 52 is formed with a horizontally oriented bore 56 into which detent 54 extends. As previously noted, socket 52 may be affixed by appropriate adhesive means or the like to the top of push rod 32 to act as an integrally formed portion of second push rod 32.

Figure 6:
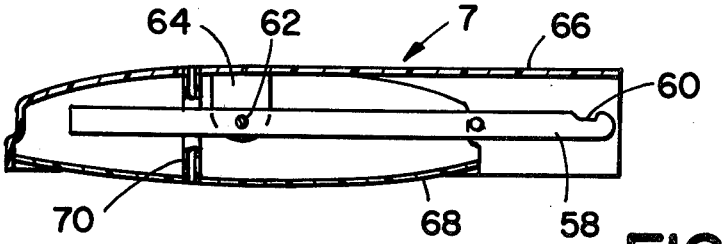
FIG. 6 is a sectional view of the cover for the cup shown in FIG. 1.

Referring to FIG. 6, cover 7 is formed with a pivoted arm 58 adapted to pass through hole 56. Arm 58 has formed thereon a groove 60 proximate the end, in which detent 54 may seat with the cover in the position shown in FIG. 1. Arm 58, as noted, is pivoted on a pin 62 generally at the midpoint of cover 7 by means of two subtending gudgeons 64, one of which is shown in FIG. 6.

Cover 7 is formed of a first portion 66 on which gudgeons 64 are mounted, and a second portion 68 mounted generally in first portion 66 and having a convex shape as shown in FIG. 6 to seat in the opening of cup member 6. A capillary tube 70 transpierces first portion 66 and second portion 68 thus communicating the cavity of cup member 6 with the atmosphere. Capillary tube 70 serves to vent the interior portion of the cup thus preventing the cover 7 from seizing on the cup member 6 due to a partially evacuated condition resulting from a drop in temperature in enclosed fluid. It further serves to prevent the cover 7 from intermittently rising from the top of the cup member 6 due to increasing temperature of a contained cold fluid in the cup 6 and the attendant expanding gases located above the fluid. The pivoted connection of arm 58 at pin 62 allows a "floating" action of the cover 7 as it comes into engagement with the cup member 6, while helical spring 46 is of sufficient strength to insure a generally fluid-tight seal. Finally, a pin 74 extends upwardly from handle 8 to limit rotation of socket 52.

In operation of the preferred embodiment, reference is made to FIG. 1. The user is expected to pick up the cup 5 in the normal manner through the use of the handle 8. In order to open the cup 5, the user places his thumb or other finger on flange 26 and pushes downwardly. Pushing downwardly on flange 26 rotates the pivoted member 30 in a clockwise direction, as shown in FIG. 3, thus urging the second push rod 32 upwardly. Camming action of the axial slot 36 and helical slot 34 first causes the cover 7 to rise vertically and then commence rotating into the plane of the paper as shown in FIG. 1. This permits the user to drink from the cup in the normal manner with the cover displaced to one side of the opening formed in the cup. Release of the pressure on flange 26 results in the opposite motion with the cover rotating backwardly and downwardly to come into engagement with the top of the cup member 6, thus generally sealing the cup. The second portion 68 of the cover 7 serves to act as a general fluid-tight seal to prevent excessive loss of fluid in the event the cup is overturned. If the helix 34 is formed in the other opposite direction, the cover 7 is rotated out of the paper as shown in FIG. 1, and the pin 74 may be positioned on the opposite side of socket 54 to limit rotation in the opposite direction.

Figure 5:
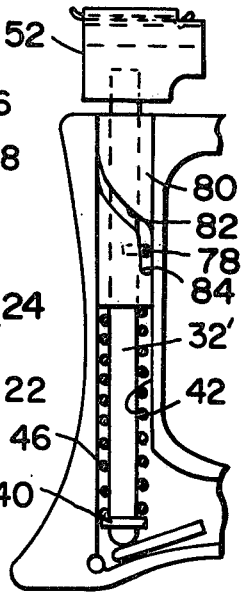
FIG. 5 is a second embodiment of the rotating mechanism shown in FIG. 3.

An alternate embodiment of the actuating mechanism is shown in FIG. 5. Like members contain the same numerals with the addition of primes ('). Specifically, the second push rod 32' is formed this time with a radially extending pin 78 with the helix formed in a sleeve member 80 disposed in the relieved portion of second section 12. The pin 78 thus acts on a camming surface formed in the helix 82 defined in sleeve 80 in a manner similar to that described in the primary embodiment. Similarly, the helix 80 may terminate in an axially oriented slot 84 at the lower end of the helix, as opposed to the upper end, for the axially oriented slot 36 in the primary embodiment. It should be apparent that pin 78, which is affixed to second push rod 32, is positioned in the axially oriented slot and thus travels upwardly in the helical slot formed in sleeve 80. This, of course, is opposite the action of the pin being fixed in the handle wherein the second member 32 travels upwardly relative the pin.

Operation of the alternate embodiment is identical to that of the primary embodiment; however, the cam and pin functions are reversed in the two embodiments. The action of the cover is identical. Finally, in both embodiments, the cover may be removed by applying a slight pressure thereto and pulling the cover 7 leftwardly, as shown in FIG. 1, thus relieving the detent 54 from the groove 60. Such removal permits easy cleaning of the cup and the associated members.

Still another embodiment is depicted in figures 7–10. In this third embodiment, articles that are similar or serve a similar function, carry the same numerals as in the primary embodiment but have one hundred added to the number. In certain instances where the function is split between two elements, the corresponding number is followed by a letter. New elements have been renumbered.

Figure 7:
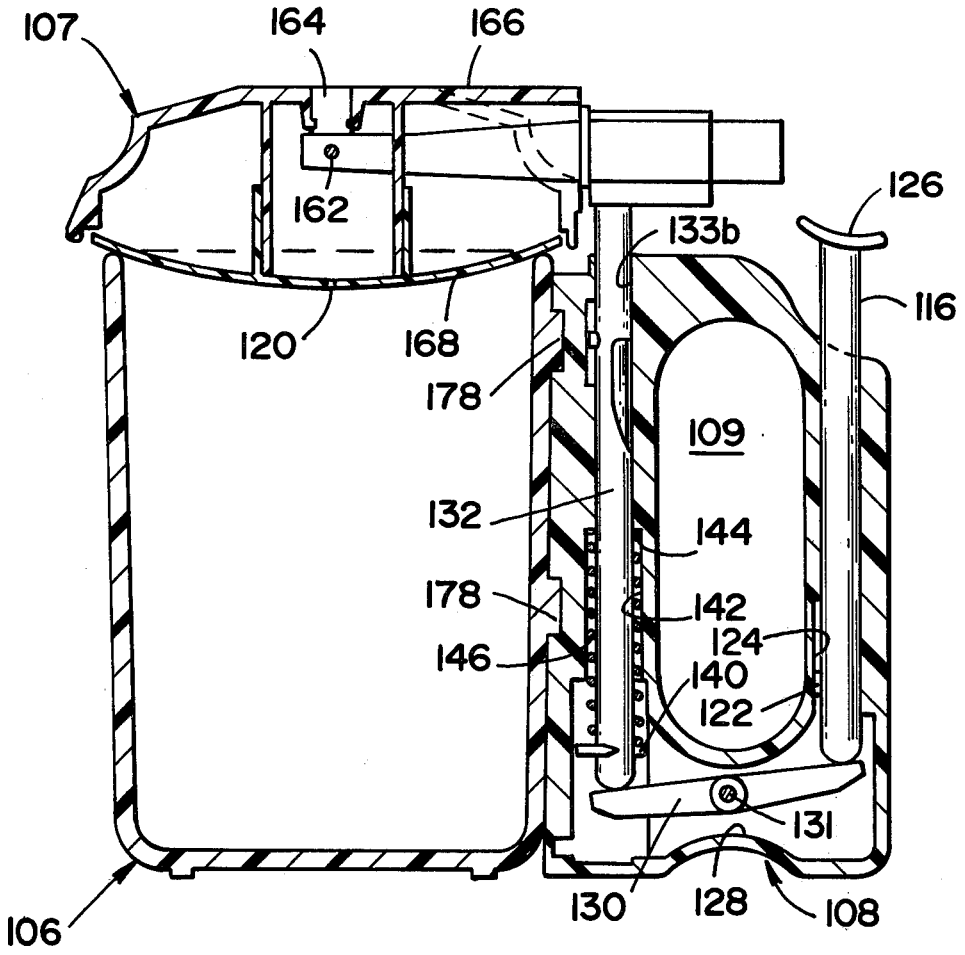
FIG. 7 is a sectional view of an alternate embodiment of the covered cup shown in FIG. 1.
Figure 8:
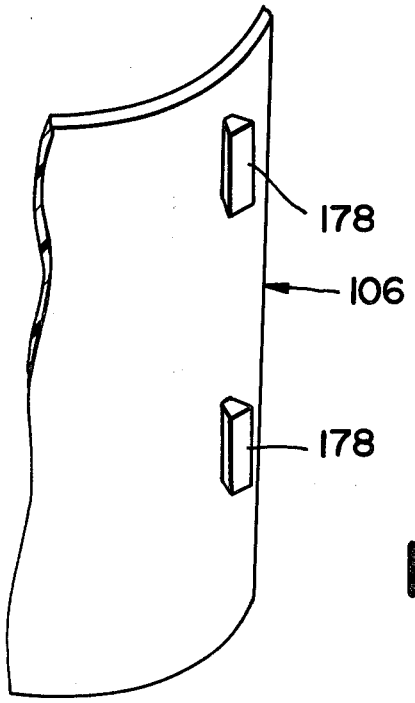
FIG. 8 is a perspective view of a portion of the cup shown in FIG. 7 with the handle and cover removed.
Figure 9:
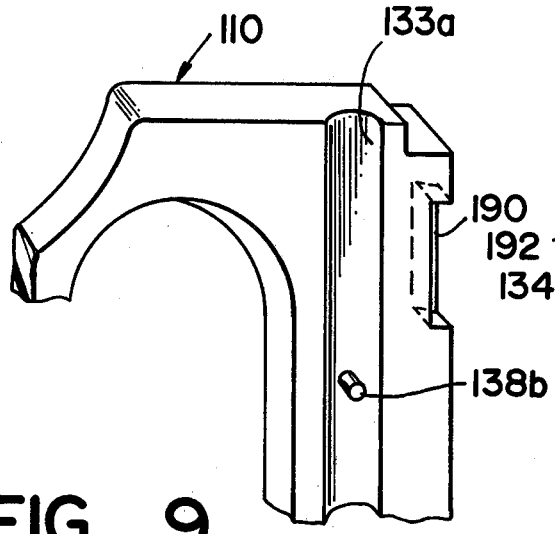
FIG. 9 is a portion of one half of the handle of the cup shown in FIG. 7.
Figure 10:
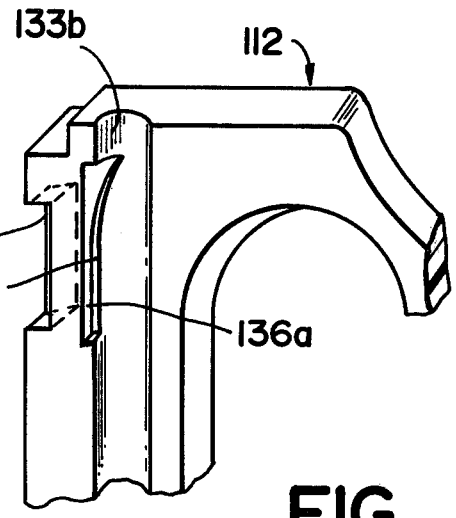
FIG. 10 is a corresponding portion of the other half of the handle shown in FIG. 9.

Referring to FIG. 7, cup 106 has affixed thereto a handle 108 which is formed in two sections, a first section 110 and a second section 112, as indicated in FIGS. 9 and 10. Reciprocally mounted in the handle 108, in its assembled form, is a first push rod 116 which has affixed at one end a key 122 which is adapted to be received in a slot 124 formed in the handle 108 as indicated in FIG. 7. Formed on the portion of first push rod 116 exterior of the handle 108 is a flange 126 adapted to fit a human digit such as a thumb. First push rod 116 operates on a pivoted member 130 at its second end. Pivoted member 130 is associated with the handle 108 by a pivot pin 131 and is free to move in a relieved portion 128 of handle 108. Pivoted member 130, in response to reciprocation of the first push rod 116, operates on a second push rod 132 which is resiliently biased by a helical spring 146 to the downward position as indicated in FIG. 7. Second push rod 132 is positioned in semi-circular recesses **133*a* in first section 110 and 133*b* in second section 112 (see FIGS. 9 and 10). Semicircular recesses 133*a* and 133*b* form a cylindrical hole in the assembled handle 108 with the first section 110 and the second section 112** assembled together.

Figure 11:
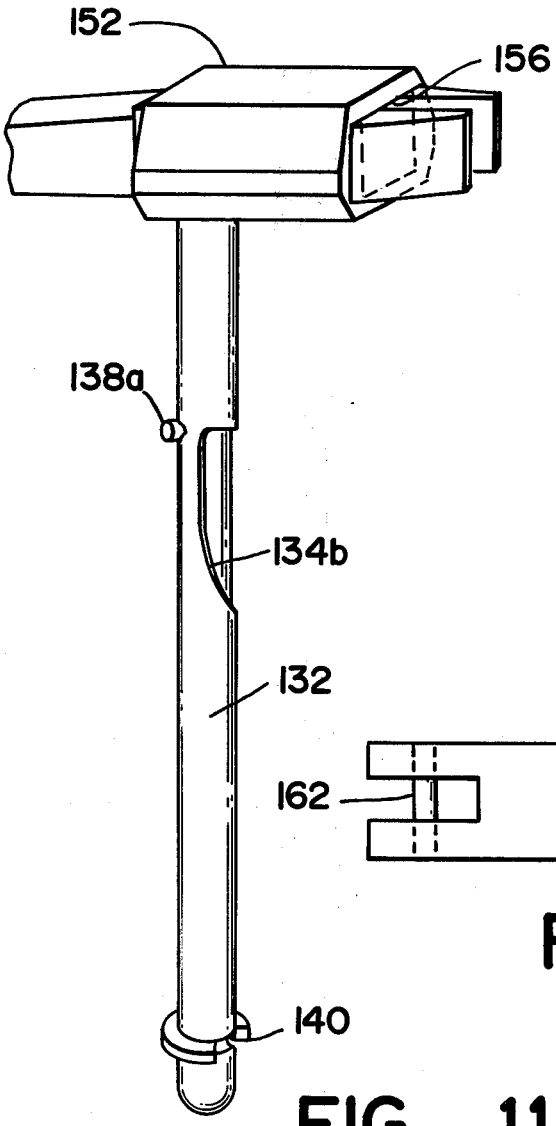
FIG. 11 is a partial perspective of the push rod actuator and socket for the cup shown in FIG. 7.

Means for rotating second push rod upon reciprocation thereof include cooperating ramps and pins formed with the handle 108 and the push rod 132. Specifically, formed in semicircular recess **133*b* is a first helical ramp 134*a* interconnecting with an axial ramp 136*a*. Disposed on second push rod 132 is an outwardly extending pin 138*a* which acts as a camming member to move upwardly and downwardly of the first helical ramp 134*a* and the axial ramp 136*a*. Formed on second push rod 132 is a relieved area which defines a second helical ramp 134*b* as indicated in FIG. 11. Second helical ramp 134*b* interconnects with axial ramp 136*b*. Disposed in semicircular recess 133*a* is a second camming pin 138*b* which moves upwardly and downwardly on second helical ramp 134*b* and second axial ramp 136*b*. It should be noted that the second axial ramp 136*b* is at the upward end of second helical ramp 134*b* while the first axial ramp 136*a* is at the lower end of first helical ramp 134*a*. Thus, with the two portions of the handles of 110 and 112 assembled and with the second push rod 132 positioned in the cylinder form by semicircular recesses 133*a* and *b*, action of the first push rod 116 on the pivoted member 130 causes the second push rod 132 to move upwardly. The pin member 138*b* operates on the second helical ramp 134*b* to rotate the second push rod 132*b* into the plane of the paper as indicated in FIG. 7. With the addition of the helical spring 146, biasing the second push rod 132 downwardly, relief of the pressure on flange 126 results in the second push rod 132 moving downwardly so that pin 138*a* affixed to second push rod 132 acts on first helical ramp 134*a* to rotate the cover toward the viewer as indicated in FIG. 7. Such rotation results in the cover 107 being seated on the cup 106** in the manner of the first and second embodiments.

Figure 12:
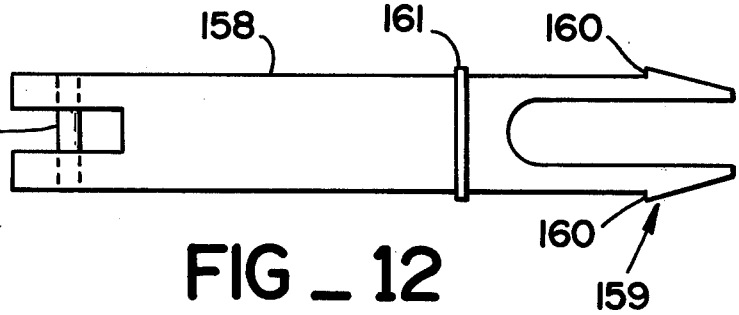
FIG. 12 is a plan view of a pivoted arm member for associating the cover with the handle.

An alternate structure for affixing the cover 107 to the socket 152 is also disclosed in this embodiment. In particular, the arm 158 is pivoted by the pin 162 to a pivot 164 affixed in the first portion of 166 of cover 107. The arm 158, as can be seen in FIG. 7, 11 and 12 is depicted as being rectilinear. Such structure is not be considered limiting since the handle could just as easily be made in a cylindrical shape. What is important is that the handle 158 is bifurcated having bifurcated legs 159 which are adapted to pass through the hole 156 formed in socket 152. When the bifurcated legs 159 passed through the hole 156, the material at the arm 158 is made of is such the bifurcated legs 159 are compressed inwardly and so a stop member 161, which may be an enlarged portion on arm 158 as indicated in FIG. 12 contacts socket 152. The bifurcated legs are formed with shoulders 160 which correspond to detent notch 60 in the primary embodiment such that shoulders 160 abut the other end of socket 152. To remove the cover, one need only squeeze the bifurcated legs 159 together so that shoulders 160 clear the opening of hole 156 so that the cover and arm may be withdrawn from the socket 152.

The second portion 168 of cover 107, in this embodiment, is formed with a hole 120 generally at the midpoint thereof. Hole 120 serves as a vent for the cavity of the cup. This structure corresponds to the capillary 70 in the primary embodiment, however, in this particular structure it is not necessary to vent to the outside atmosphere as there is a free passage of gas from the inner cavity through the opening that the arm 158 passes. The hole 120 is sufficiently small to prevent fluid from passing therethrough.

In this embodiment, the first section 110 of handle 108 is formed with a pair of keyed sockets 180 (one of which is shown in FIG. 9). Similarly, the second section 112 of handle 108 is formed with a pair of keyed sockets 192 (one of which is shown in FIG. 10). These keyed sockets are adapted to receive the pair of key shape protrusions 178 shown in FIG. 8. The handle may then be fastened with any appropriate fastening means such as a bolt or the like (not shown) or the keyed portions 190 and 192 may be extended so that the handle may be lifted on and off the cup. This method of fastening is well known in the art and is not considered limiting. Other fastening methods such as the pins depicted in the primary embodiment may also be used.

Operation of this embodiment should be apparent to those skilled in the art and furthermore it has been explained during the description of the structure. However, for clarification, actuation of first push rod 116 by pressure on flange 126 operates on pivoted member 130. Pivoted member 130 operates on second push rod 132 such that pin **138*b* works on the axial ramp 136*b* initially to cause the cover 107 to lift away from the cup and then pin 138*b* subsequently acts on second helical ramp 134*b* to cause the cover to rotate into the plane on the paper as indicated in FIG. 7. Release of the pressure on flange 126 acts in the opposite direction on pivoted member 130 such that helical spring 146 causes the second push rod 132 to move downwardly so that pin 138*b* acts on first helical ramp 134*a* and susequently on first axial ramp 136*a* to re-seat cover 107 onto cup 106. It should be noted that helical spring 146 operates between a shoulder 144 formed by an expanded semicircular recess 142 and on a split ring 140 or the like positioned in a groove formed on second push rod 132**.

To remove the cover 107 from the socket 152, the user squeezes the bifurcated legs 159 such that shoulder 160 clears the opening of hole 156 and allows passage of arm 158 through hole 156 for removal from the socket 152. In the reverse manner, arm 158 is passed into the socket 152 such that bifurcated legs 150 are compressed toward each other until the stop member 161, which may be an integral point of arm 158, contacts socket 152. Simultaneously, the bifurcated legs 159 open outwardly such that the shoulders 160 will abut the socket 152.

Although this invention has been described in relation to two embodiments, it is envisioned that the invention is not to be so limited, but rather is to be considered limited only by the appended claims.

What is claimed is:

1. A cup comprising:

a cup member;

a handle affixed to said cup member;

cover means for covering said cup;

rotating means cooperating with and disposed within said handle and responsive to manual pressure for raising and rotating said cover means so that said cup is uncovered;

said rotating means having a portion extending upwardly above said handle;

a socket connection between said cover means and said rotating means;

said cover means comprising a cover and an arm member, said arm member having one end pivotally affixed to said cover generally at the midpoint of said cover and extending radially therefrom beyond said cover, said arm member detachably affixed to said socket connection at the other end of said arm member.

2. The cup of claim 1 wherein the rotating means comprises:

a manually actuable first push rod reciprocally mounted in said handle;

a pivoted member disposed in said handle for pivoted movement in response to reciprocation of said manually actuable push rod;

a second push rod reciprocally disposed in said handle and responsive to said pivotal movement of said pivoted member reciprocating said second push rod in a first direction opposite of said first push rod;

means for axially rotating said second push rod upon reciprocation thereof toward said first direction; and, resilient means for urging said second push rod in a second direction opposite said first direction to engage said pivoted member.

3. The cup of claim 2 wherein the means for axially rotating the second push rod comprises a pin member and further wherein said second push rod defines a helically oriented slot therein, said pin member fixed relative said handle and acting as a camming member on said helically oriented to rotate said second push rod upon reciprocation of said second push rod.

4. The cup of claim 2 wherein the means for axially rotating the second push rod comprises a tubular member mounted about said second push rod and affixed to the handle, said tubular member defining a helical slot therein, and further wherein said second push rod includes a radially extending pin adapted to follow the contour of said helical slot upon reciprocation of said second push rod.

5. The cup of claim 4 wherein the tubular member defines an axial extension to the helical slot, said axial extension generally parallel to the axis of reciprocation of the second push rod, the radially extending pin positioned in said axial extension, so that initial movement of said second push rod in response to movement of said first push rod is generally without rotation.

6. The cup of claim 2 wherein the means of axially rotating the second push rod comprises a first pin mounted in the handle and a second pin mounted in said second push rod, said handle defining a first helical ramp acting as a camming surface for said second pin, said second push rod defining a second helical ramp acting as a camming surface for said first pin, so that upon reciprocation of said second push rod said second push rod rotates in a first direction upon reciprocation in a first linear direction and rotates in a second direction upon reciprocation in the second opposite linear direction.

7. The cup of claim 1 wherein the cover further comprises a first portion and second portion, said first and second portions affixed together to form an insulating cavity therebetween, said second portion adapted to abut the open end of the cup in a generally fluid-type relation.

8. The cup of claim 7 wherein the cover further comprises vent means transpiercing the insulating cavity for venting the cup while said cover is in a covering position.

9. A cup comprising:

a cup member;

a handle affixed to said cup member;

cover means for covering said cup; and rotating means cooperating with said handle and disposed within said handle; said rotating means responsive to manual pressure for raising and rotating said cover means so that said cup is uncovered;

said rotating means having a portion extending upwardly above said handle and, socket means for connecting said cover means and said rotating means;

said rotating means comprising a manually actuable first push rod reciprocally mounted in said handle; a pivoted member disposed in said handle for pivoted movement in response to reciprocation of said manually actuable push rod; a second push rod reciprocally disposed in said handle and responsive to said pivotable movement of said pivoted member reciprocating said second push rod in a first direction opposite said first push rod; means for axially rotating said second push rod upon reciprocation thereof toward said first direction; and resilient means for urging said second push rod in a second direction opposite said first direction to engage said pivoted member;

said socket means affixed to said second push rod distal of said pivoted member.

* * * * *